United States Patent [19]

Kennedy et al.

[11] 4,118,894

[45] Oct. 10, 1978

[54] DOOR FRAME AND DOOR ASSEMBLY FOR A MINE STOPPING

[76] Inventors: John M. Kennedy; William R. Kennedy, both of P.O. Box 38, Taylorville, Ill. 62568

[21] Appl. No.: 798,770

[22] Filed: May 27, 1977

[51] Int. Cl.[2] ..... E05D 7/00

[52] U.S. Cl. ..... 49/402; 49/485

[58] Field of Search ..... 49/402, 400, 401, 504, 49/485

[56] References Cited

U.S. PATENT DOCUMENTS

| | | | |
|---|---|---|---|
| 1,948,602 | 2/1934 | Tracy | 49/400 |
| 2,640,230 | 6/1953 | Eck et al. | 49/402 |
| 2,886,861 | 5/1959 | Bartlett | 49/402 |

*Primary Examiner*—Kenneth Downey

*Attorney, Agent, or Firm*—Koenig, Senniger, Powers and Leavitt

[57] ABSTRACT

A door frame and door assembly for a doorway in a mine stopping in which the door is hinged to the top of the door frame, and hangs down at an angle from the top of the frame when closed with sealing surfaces of the door at the top, bottom and sides of the door in face-to-face engagement with forward faces of the top, bottom and sides of the frame, the forward face of the bottom being forward of the forward face of the top, and the forward faces of the sides of the frame being inclined.

7 Claims, 3 Drawing Figures

DOOR FRAME AND DOOR ASSEMBLY FOR A MINE STOPPING

BACKGROUND OF THE INVENTION

This invention relates to a door frame and door assembly for a mine stopping, and more particularly to such an assembly for installation in a man-door opening in a mine stopping.

So-called "stoppings" are widely used in mines to stop off flow of air in passages in the mines, a stopping generally being a masonry (e.g., concrete block) or metal wall installed at the entrance of a passage to block flow of air therethrough. It is often desired that such stoppings be provided with a door, which is referred to as a "man door", for occasional access to the blocked-off passage. A serious problem is encountered, however, in providing a door for a stopping because heaving and shifting of the stopping such as often occurs may cause the door to become jammed, and may cause leakage of air contra to the purpose of the stopping.

The invention is in the same field as and may be regarded as representing an improvement upon the door for a mine stopping disclosed and claimed in our copending U.S. Pat. application Ser. No. 738,690, filed Nov. 4, 1976,

SUMMARY OF THE INVENTION

Among the several objects of this invention may be noted the provision of an improved door frame and door assembly for a mine stopping of such construction that even though the frame may become distorted due to shifting of the stopping, such as caused by heaving of the floor of the passage in the mine in which the stopping is installed, the door will not become jammed and remains capable of being readily opened for access to the blocked-off passage even after such shifting, and also remains closed so as to maintain an air-tight seal; the provision of such an assembly in which the door is self-closing and remains closed without requiring a latch; and the provision of such an assembly which, while being effective for its purpose, is of simple and economical construction.

In general, a door and frame assembly of this invention comprises a rectangular frame having a top, bottom and sides and a door hinged to the top of the frame and adapted to swing down for closing and to swing up for opening. The frame is adapted to be mounted in a man-door opening in a mine stopping with the bottom of the frame bearing on the stopping at the bottom of the man-door opening, the sides of the frame extending up at opposite sides of the man-door opening and the top of the frame forming a lintel at the top of the man-door opening. The top, bottom and sides of the frame each has a face engageable by the door when the door swings down, each said face constituting a forward face. The bottom of the frame extends forward beyond the vertical plane of the forward face of the top of the frame so that the forward face of the bottom is forward of the forward face of the top. The sides also extend forward beyond the vertical plane of the forward face of the top of the frame and the forward faces of the sides are inclined outwardly in downward direction from the ends of the forward face of the top of the frame to the ends of the forward face of the bottom of the frame. The door has sealing surfaces at the top, bottom and sides thereof engageable in face-to-face relation with the said forward faces of the top, bottom and sides of the frame when the door swings down to seal the opening in the frame, gravity and air pressure on the forward face of the door being adapted to hold the door closed with its said sealing surfaces in face-to-face engagement with said forward faces of the frame. The frame is adapted to distort out of rectangular shape, e.g., to distort to a non-rectangular parallelogrammatic shape, or to have its bottom arch upwardly and its top arch downwardly, without jamming the door or breaking the air-tight seal.

Other objects and features will be in part apparent and in part pointed out hereinafter.

BRIEF DESCRIPTION OF THE DRAWINGS

Corresponding reference characters indicate corresponding parts throughout several views of the drawings.

DESCRIPTION OF THE PREFERRED EMBODIMENT

Figure 1:
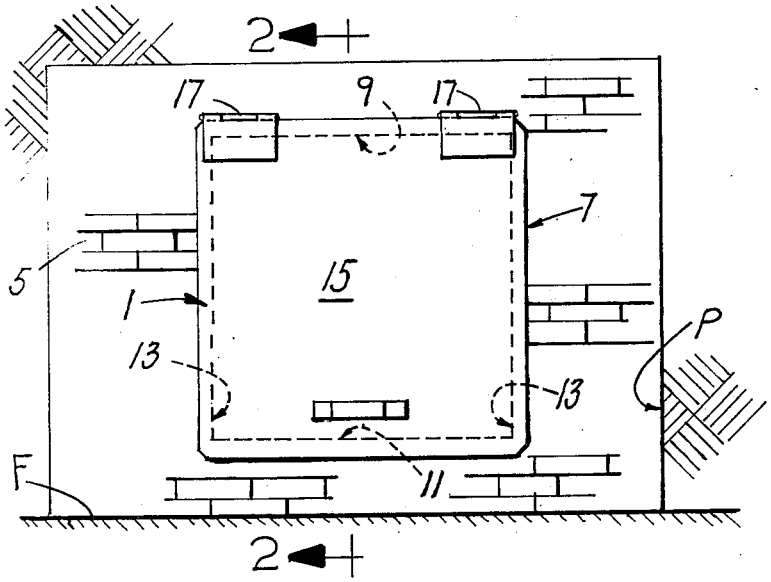
FIG. 1 is a view showing a mine stopping having a door frame and door assembly of this invention installed therein.

Referring to the drawings, there is generally indicated at 1 a door frame and door assembly of this invention as installed in a man-door opening indicated at 3 in a masonry mine stopping 5, e.g., a concrete block mine stopping, the latter typically being built up at the entrance of a no longer used passage P in a mine to block flow of air through the passage. The assembly 1 comprises a rectangular frame 7 having a top 9, bottom 11 and left and right sides each designated 13, and a door 15 hinged as indicated at 17 to the top 9 of the frame adapted to swing down for closing and to swing up for opening. Typically, the frame is generally square, measuring about 32 inches wide and 32 inches high inside dimensions. The frame is in effect mounted in the man-door opening 3 in the stopping 5 with the bottom or sill 11 of the frame bearing on the stopping at the bottom of the man-door opening 3, the sides 13 of the frame extending up at opposite sides of the opening 3, and the top 9 of the frame forming a lintel at the top of the opening 3. As will be understood, typically the stopping will be built up as a wall of concrete blocks from the floor F of the passage P to the level of the bottom of the opening 3, the frame 7 (with the door 15) mounted in position on the blocks, and the remainder of the wall built up around the frame.

As illustrated, the top 9 of the frame 7 is constituted by a metal channel member with a width W1 between the upwardly extending forward and rearward flanges 19 and 21 of the channel member slightly greater than the thickness of the concrete blocks of which the stopping is built, (e.g., 8 inches). The web of the top channel member 9 is designated 23. This member opens upwardly. The flange 19 is the forward flange of the top channel member 9 at the door face of the frame 7, and its outside or forward face is specially designated 25.

Figure 2:
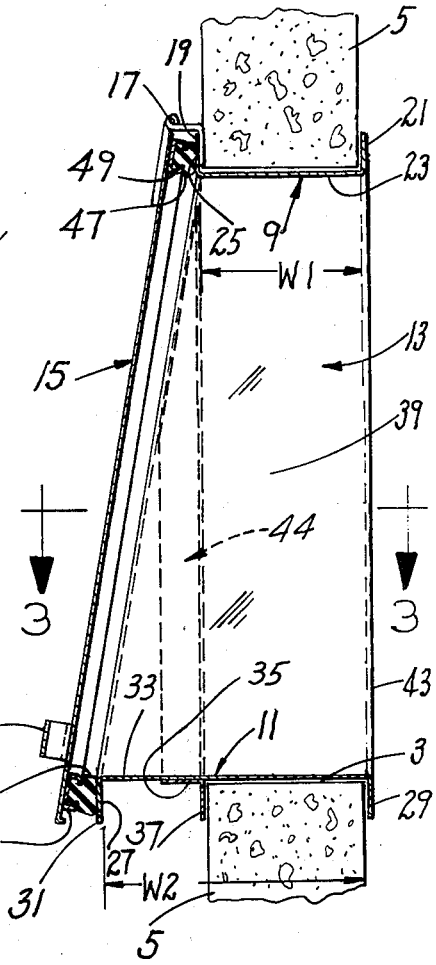
FIG. 2 is a vertical section on line 2—2 of FIG. 1.
Figure 3:
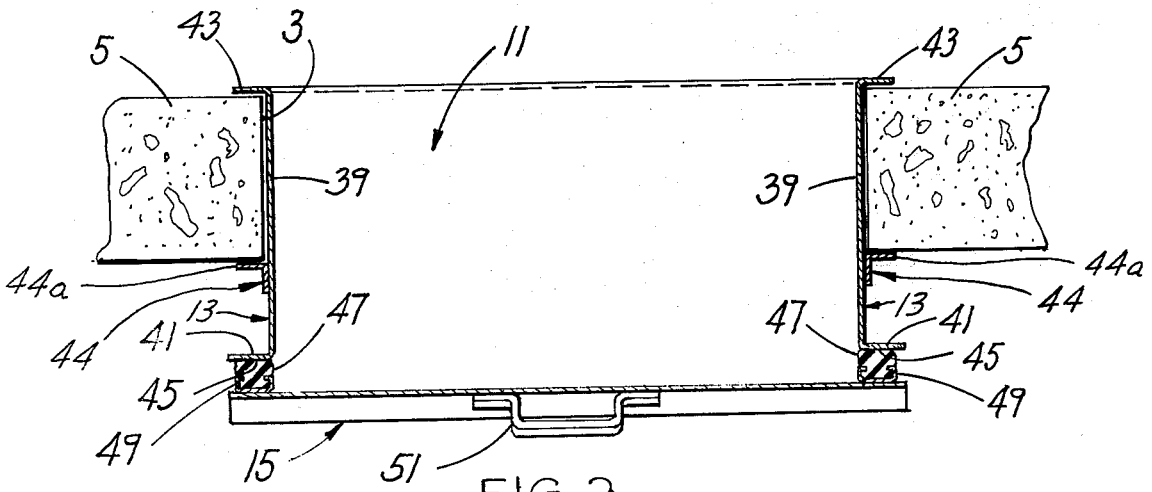
FIG. 3 is a horizontal section on line 3—3 of FIG. 1.

The bottom 11 of the frame 7 comprises a metal channel member with a width W2 between the downwardly extending forward and rearward flanges 27 and 29 of this member greater than the width of the top channel member 9. The flange 27 is the forward flange of member 11 at the door face of the frame 7, and the outside or forward face of this flange is specially designated 31. The web of member 11 is designated 33. Member 11 opens downwardly, and has an angle member 35 welded to its web 33 on the inside of the web extending lengthwise thereof with one leg 37 of the angle iron extending downwardly from web 33 spaced from flange 29 a distance corresponding to W1 flange 21 of the top channel member 9 of the frame 7 and flange 29 of the bottom channel member 11 of the frame are generally coplanar in a vertical plane. The bottom channel member, being considerably wider than the top channel member, extends forward (i.e., toward the left as viewed in FIG. 2) beyond the vertical plane of the forward face 25 of the top channel member (i.e., the outside face 25 of flange 19 of the top channel member).

Each side 13 of the frame 7 is of channel shape in cross section, having a web 39 and laterally outwardly extending forward and rear flanges 41 and 43, the web 39 at the top having a width corresponding to W1 and at the bottom having a width corresponding to W2. The rear flanges 43 of the sides 13 are coplanar with the rear flanges 21 and 29 of the top and bottom channel members 9 and 11 of the frame 7 in the vertical plane of flanges 21 and 29. Each side 13 of the frame also extends forward beyond the vertical plane of the forward face 25 of the top channel member 9, the forward flanges 41 of the frame and thus their outside or forward faces 45 being inclined outwardly in downward direction from the ends of the forward face 25 of the top channel member 9 of the frame to the ends of the forward face 31 of the bottom 11 of the frame. Angle members 44 are welded to the outside of the webs 39 of the sides 13 extending vertically in the vertical plane of the angle member 35. Leg **44*a* of each of these members is spaced from the rear flanges 43** of the sides the distance W1.

The door 15 is formed of metal plate having sealing surfaces at its top, bottom and sides engageable generally flatwise in face-to-face relation with the forward faces 25, 31 and 45 of the top, bottom and sides 9, 11 and 13 of the frame 7 when the door swings down on its hinges to seal the opening in the frame bounded by the top, bottom and sides 9, 11 and 13. These sealing surfaces are the faces of a resilient gasket 47, made of a suitable rubber or other elastomer, secured to the inside face of the door all around the door by channel members such as indicated at 49. A handle for the door is indicated at 51.

With the above-described arrangement, gravity and air pressure on the forward face of the door are adapted to hold the door closed with the gasket 47 in face-to-face sealing engagement with the forward faces 25, 31 and 45 of the top, bottom and sides 9, 11 and 13 of the frame 7. The frame is adapted to distort out of rectangular shape, e.g., to distort to a non-rectangular parallelogrammatic shape or to have its bottom arch upwardly and its top arch downwardly, on heaving and shifting of the stopping 5 without jamming the door and without breaking the air-tight seal, so that the door remains capable of being readily opened by swinging it up on its hinges 17 for access to the blocked-off passage P after such shifting. The sealing surfaces may slide relative to the forward faces of the forward flanges of the frame on distortion of the frame, the door being free of any engagement around the outer edges of the said forward flanges for this purpose. The door is self-closing, before and after heaving or shifting of the stopping, and remains closed without requiring a latch.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limit-sense.

What is claimed is:

1. A door frame and door assembly for installation in a man-door opening in a mine stopping, said assembly comprising a rectangular frame having a top, bottom and sides and a door hinged to the top of the frame and adapted to swing down for closing and to swing up for opening, the frame being adapted to be mounted in a man-door opening in a mine stopping with the bottom of the frame bearing on the stopping at the bottom of the man-door opening, the sides of the frame extending up at opposite sides of the man-door opening and the top of the frame forming a lintel at the top of the man-door opening, the top, bottom and sides of the frame each having a face engageable by the door when the door swings down, each said face constituting a forward face, the bottom of the frame extending forward beyond the vertical plane of the forward face of the top of the frame so that the forward face of the bottom is forward of the forward face of the top, the sides also extending forward beyond the vertical plane of the forward face of the top of the frame and the forward faces of the sides being inclined outwardly in downward direction from the ends of the forward face of the top of the frame to the ends of the forward face of the bottom of the frame, the door having sealing surfaces at the top, bottom and sides thereof engageable in face-to-face relation with the said forward faces of the top, bottom and sides of the frame when the door swings down to seal the opening in the frame, gravity and air pressure on the forward face of the door being adapted to hold the door closed with its said sealing surfaces in face-to-face engagement with said forward faces of the frame, the top of the frame having an upwardly extending forward flange, the bottom having a downwardly extending forward flange, and the sides having laterally outwardly extending forward flanges which are inclined forward in downward direction from the ends of the forward flange of the top to the ends of the forward flange of the bottom, the forward faces of said top, bottom and sides being constituted by the forward faces of the said forward flanges of said top, bottom and sides, the said sealing surfaces of the door being engageable generally flatwise in face-to-face engagement with the forward faces of said forward flanges so that the sealing surfaces may slide relative to said forward faces on distortion of the frame out of rectangular shape, e.g., to distort to a non-rectangular parallelogrammatic shape, to avoid jamming of the door, the door being free of any engagement around the outer edges of the said forward flanges so that the sealing surfaces may slide relative to the said forward faces.

2. A door frame and door assembly as set forth in claim 1 wherein each of the top, bottom and sides of the frame is constituted by a metal channel member having a web, a rear flange and the respective forward flange, the rear flanges of said top, bottom and sides being coplanar, the top flanges extending upwardly, the bottom flanges extending downwardly, the side flanges extending outwardly, the bottom channel member extending forward beyond the vertical plane of the forward flange of the top so that the forward face of the forward flange of the bottom is forward of the forward face of the forward flange of the top.

3. A door and door frame assembly as set forth in claim 2 wherein the bottom of the frame has a leg spaced from its rear flange a distance corresponding generally to the spacing of the flanges of the top.

4. A door and door frame assembly as set forth in claim 3 wherein the door has a gasket engageable with the forward faces of the front flanges of the top, bottom and sides of the frame.

5. A door and door frame assembly as set forth in claim 2 wherein each side of the frame has a vertical member spaced from its rear flange a distance corresponding generally to the spacing of the flanges of the top.

6. A door and door frame assembly as set forth in claim 5 wherein the bottom of the frame has a leg spaced from its rear flange a distance corresponding generally to the spacing of the flanges of the top.

7. A door and door frame assembly as set forth in claim 6 wherein the door has a gasket engageable with the forward faces of the front flanges of the top, bottom and sides of the frame.

* * * * *